United States Patent [19]

Asick et al.

[11] Patent Number: 4,489,998

[45] Date of Patent: Dec. 25, 1984

[54] BUSSING CONNECTOR SYSTEM

[75] Inventors: John C. Asick, Harrisburg; George H. Douty, Mifflintown; Joseph R. Goodman, Lake City; Kermit M. Jones, Jr.; John M. Landis, both of Camp Hill; Clair W. Snyder, Jr., York; John A. Woratyla, Camp Hill; Dale R. Zell, Elizabethtown, all of Pa.

[73] Assignee: AMP Incorporated, Harrisburg, Pa.

[21] Appl. No.: 437,997

[22] Filed: Nov. 1, 1982

[51] Int. Cl.[3] ..... H01R 25/16

[52] U.S. Cl. ..... 339/17 LM; 339/17 M; 339/19; 339/176 M

[58] Field of Search ..... 339/19, 222, 176 M, 339/17 M, 17 LM

[56] References Cited

U.S. PATENT DOCUMENTS

| | | | |
|---|---|---|---|
| 2,701,346 | 2/1955 | Powell | 339/17 M |
| 2,904,768 | 9/1959 | Rasmussen | 339/17 LM |
| 3,193,787 | 7/1965 | McGhee | 339/17 LM |
| 3,206,648 | 9/1965 | Jordan et al. | 339/17 M |
| 3,404,367 | 10/1968 | Henschen | 339/217 |
| 3,634,816 | 1/1972 | Zell | 339/186 |
| 3,731,254 | 5/1973 | Key | 339/19 |
| 4,050,758 | 9/1977 | Curley | 339/176 M |
| 4,133,592 | 1/1979 | Cobaugh et al. | 339/17 M |
| 4,186,982 | 2/1980 | Cobaugh et al. | 339/17 C |
| 4,384,754 | 5/1983 | Dout et al. | 339/19 |

FOREIGN PATENT DOCUMENTS

| | | | |
|---|---|---|---|
| 0004422 | 10/1979 | European Pat. Off. | 399/176 M |

*Primary Examiner*—John McQuade
*Assistant Examiner*—Thomas M. Kline
*Attorney, Agent, or Firm*—Russell J. Egan

[57] ABSTRACT

A bussing system for interconnecting circuits on pairs of adjacent parallel spaced circuit boards is formed by a bussing connector for each pair of circuit boards and a connector assembly on each circuit board. Each connector assembly has a header mounted on a first side of the circuit board, a shroud mounted on the opposite side of the circuit board, and a plurality of terminals mounted extending through the header, shroud and circuit board and making electrical contact with the latter. Each bussing connector includes a plurality of terminals mounted therein, each capable of engaging a pin terminal extending from a header of a first circuit board and a pin terminal extending from a shroud of a second circuit board.

15 Claims, 11 Drawing Figures

BUSSING CONNECTOR SYSTEM

The present invention relates to a bussing connector system for providing a pluggable interconnect between conductive planes of adjacent pairs of parallel, spaced circuit boards.

The prior art is represented by U.S. Pat. Nos. 3,404,367 and 3,634,816 both of which show a mother circuit board having a plurality of connector members attached thereto and the like plurality of daughter boards each having an edge connector received in a respective one of the mother circuit board connectors. U.S. Pat. No. 4,133,592 shows a connector for electrically and mechanically joining a plurality of circuit boards in a stack. This arrangement has a clear disadvantage in that the boards towards the middle of the stack are not readily accessible. Such arrangements are not readily adaptable and have the obvious disadvantage in that they must initially be designed into a system and then are rather fixed in configuration. They are, generally, rather expensive to install and maintain.

The present invention pertains to a connector system which can be used to selectively connect any number of pairs of adjacent parallel spaced circuit boards. The subject connector system includes a bussing connector for each pair of circuit boards and a connector assembly mounted on each circuit board. Each bussing connector has a housing of rigid insulative material with a plurality of parallel spaced profiled slots. Each slot includes a groove on each opposite face of the connector extending away from a mating face in parallel spaced fashion. The bussing connector has a plurality of receptacle terminals, each mounted in a respective slot in the housing and each terminal having a cross bar portion and a pair of parallel spaced contact legs which lie in respective grooves. The connector assembly on each circuit board includes a pin header and a pin shroud mounted on opposite sides of a mating edge portion of each circuit board. Each header and each shroud have a plurality of terminal passages extending therethrough, each aligned with a respective conductive aperture in the circuit board. A plurality of pin terminals extend through the respective passages and conductive aperture of the circuit board to project from both oppositely directed mating faces of the header and shroud. The bussing connector terminals engage the pin terminals extending from the mating face of a pin header of a first circuit board and the pin terminals extending from the shroud of a second circuit board so that the circuits of the first and second boards are bussed together.

The present invention will be described by way of non-limiting example with reference to the accompanying drawings in which.

Figure 1:
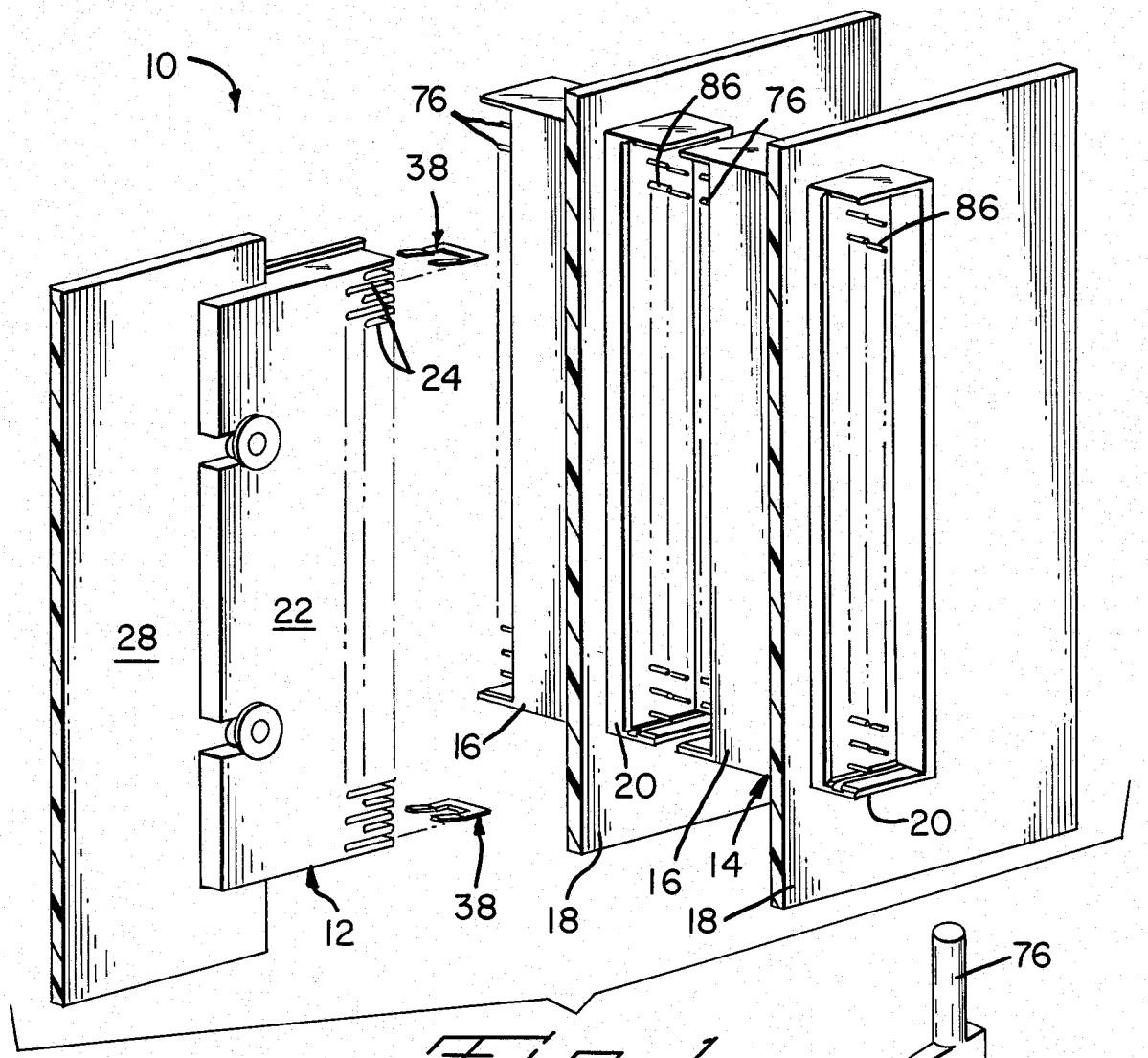
FIG. 1 is an exploded perspective view of the subject connector system according to the present invention.
Figure 6:
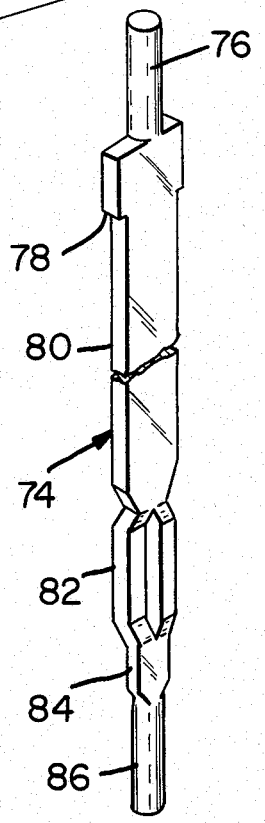
FIG. 6 is a perspective view of a pin terminal of the type used in the present invention.

The subject bussing system 20 is formed by a bussing connector 12, a pin connector assembly 14 formed by a pin header 16 mounted on a first side of a circuit board 18, and a pin shroud 20 mounted on a second opposite side of circuit board 18.

Figure 5:
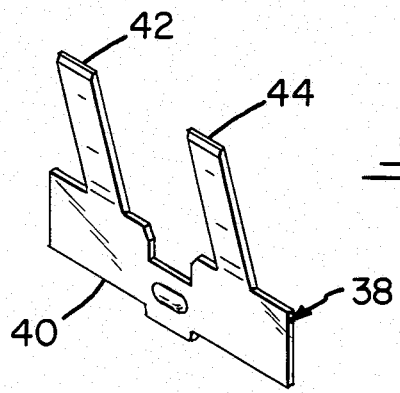
FIG. 5 is a perspective view of a bussing terminal of the type used in the present invention.
Figure 2:
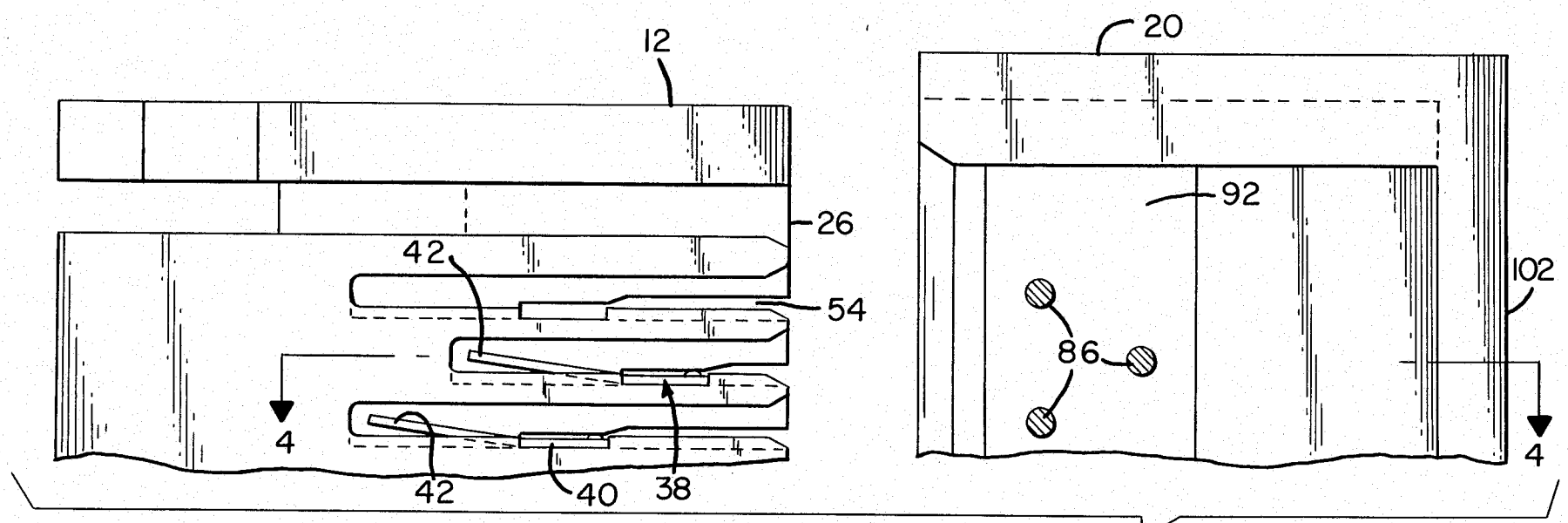
FIG. 2 is an elevation taken along line 2—2 of FIG. 4 showing an end portion of the subject connector system according to the present invention in an unmated condition.
Figure 9:
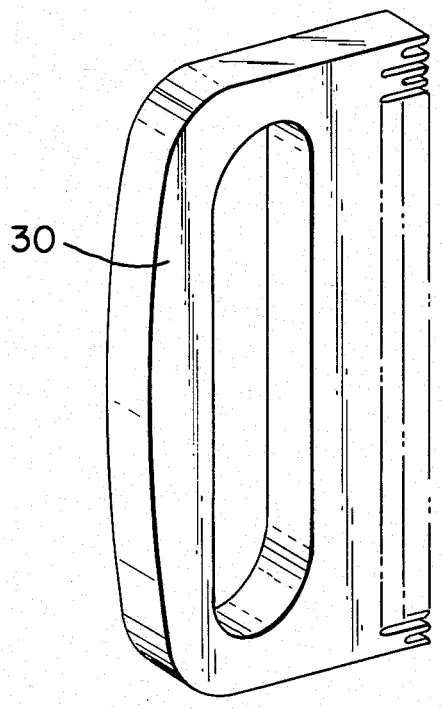
FIG. 9 is a perspective view of an alternate bussing connector for use in the present invention.
Figure 10:
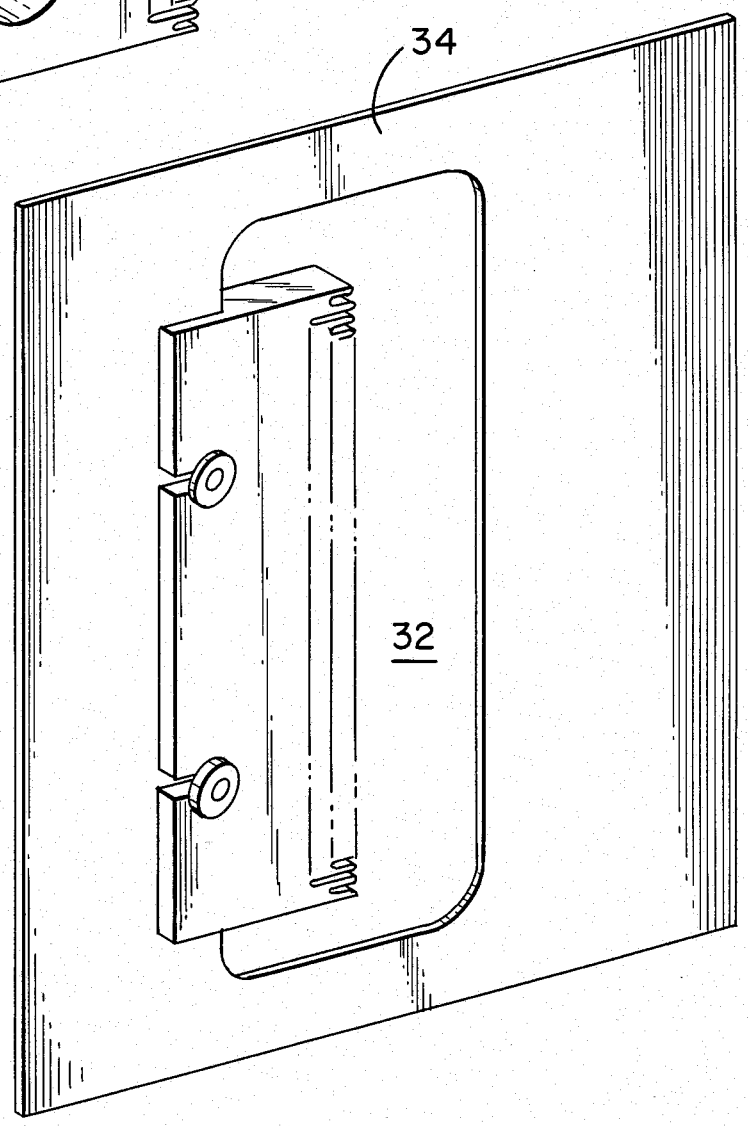
FIG. 10 is a perspective view of a further alternate embodiment of a bussing connector for the subject invention.
Figure 11:
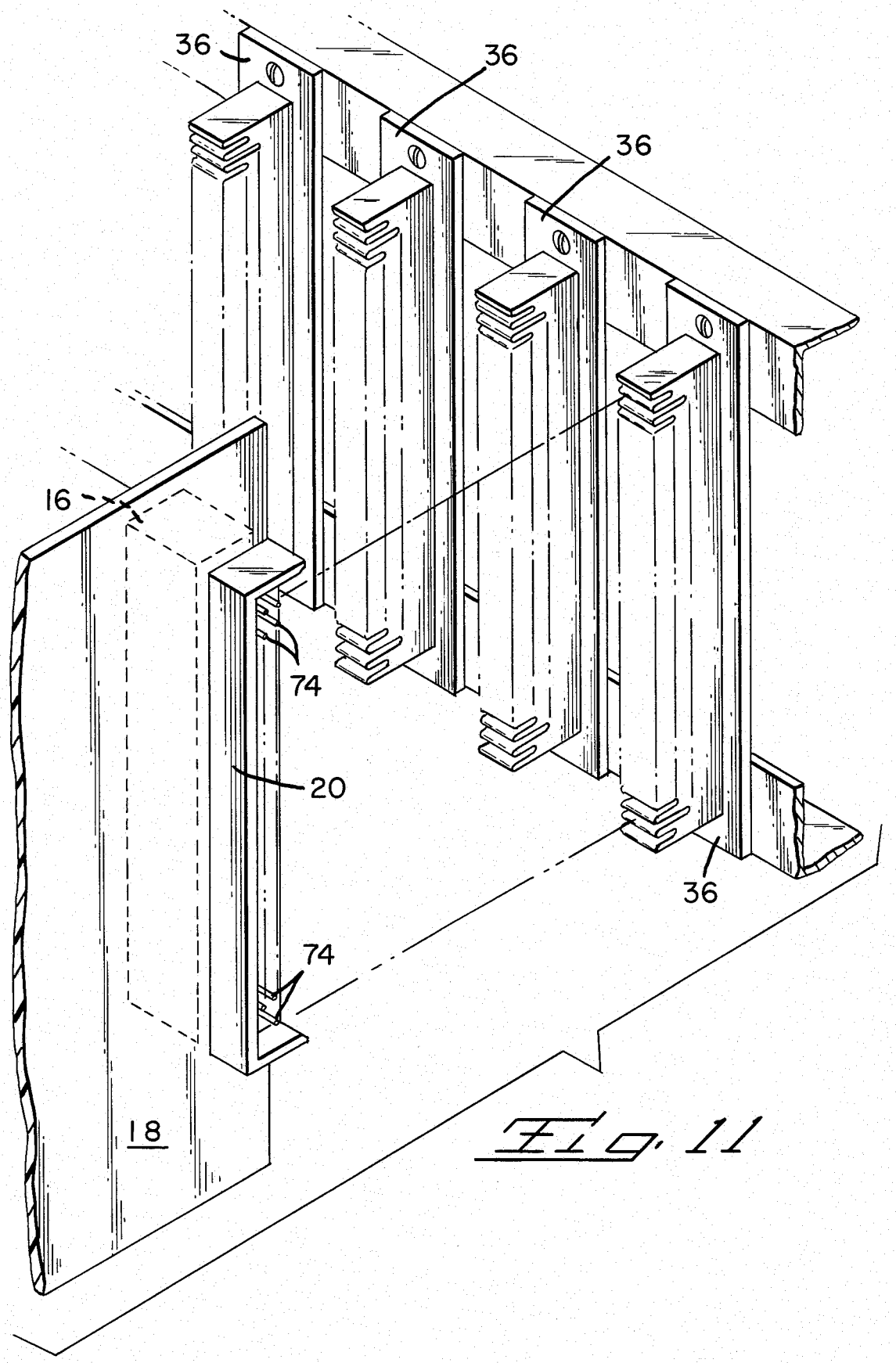
FIG. 11 is a perspective view of the subject invention in a backplane mounting configuration.

The bussing connector 12 has a housing 22 made of rigid insulative material defining a plurality of parallel spaced apart slots 24 extending inwardly along a mating face 26 thereof. The connector can be mounted on a chassis 28, as shown in FIG. 1, or may be formed with a handle 30, as shown in FIG. 9, or extending into an aperture 32 in a mother circuit board 34, as shown in FIG. 10, or as a back plane 36, as shown in FIG. 11. A plurality of receptacle contacts 38, as best seen in FIG. 5, are mounted in each respective slot 24 of the bussing connector 12. Each terminal 38 has a cross bar portion 40 and a pair of integral parallel spaced contacting legs 42, 44 extending normal to the cross bar. The terminal can also be provided with retention means. The slots 24 are profiled, as best seen from FIGS. 2 and 4. Each slot has a profiled side groove 46, 48 extending in spaced parallel relationship on opposite sides of the receptacle connector 12 with each groove having a recess 50, 52 spaced from the mating face 26. The grooves 46, 48 are interconnected at the mating face 26 by a slot 54. Each terminal 38 is mounted in a respective slot 24, in the manner shown in FIGS. 2 and 4, with the legs 42, 44 extending the length of respective grooves 46, 48 and with the cross bar 40 lying in the respective recesses 50, 52 and extending through the slot 54.

Each pin header 16 is an elongated member 56 of rigid insulative material having a first printed board engaging surface 58 and oppositely directed mating face 60 enclosed on three sides by keyed end flanges 62, 64 and elongated flange 66. A plurality of terminal passages 68 extend between the surface 58 and face 60 and each is aligned with a respective conductive aperture 70 in the circuit board 18. The header 16 also includes at least one mounting aperture 72 extending between the surface 58 and mating face 60. A plurality of terminals 74 are mounted in the respective passages 68 of the header 16 with each terminal 74 having a first pin portion 76, mounting shoulders 78, a first body portion 80, a compliant mounting portion 82, a second body portion 84, and a second oppositely directed pin portion 86. This terminal is preferably formed from flat stock with the compliant mounting portion 82 formed in the manner of U.S. Pat. No. 4,186,982, the disclosure of which is incorporated herein by reference. Each terminal 74 is mounted in a respective passage 68 and help to secure the header 16 on the circuit board 18 by insertion of the compliant portion 82 of the terminals 74 into the respective conductive holes 70 of the circuit board 18. It should be noted here that the pin portions 76, 86 can have any section shape, such as round or square.

The pin shroud 20 is mounted from the opposite side of the circuit board 18. The shroud 20 likewise is an elongated member 88 of rigid insulative material having a circuit board contacting surface 90 and oppositely directed parallel spaced mating face 92, a plurality of terminal passages 94 extending between surface 90 and face 92 and at least one mounting stud 96. The mating face 92 is enclosed on three sides by keyed end walls 98, 100 and elongated wall 102. The pin shroud 20 is mounted on the opposite side of the circuit board 18 from the header 16 by applying it so the second body 84 of the terminal 74 can extend through the passages 94 with the second pins 86 extending from the mating face 92. The mounting stud 96 passes through an aperture 97 in the circuit board 18 to engage in the mounting aperture 72 in the pin header 16 with a frictional fit engagement.

Figure 3:
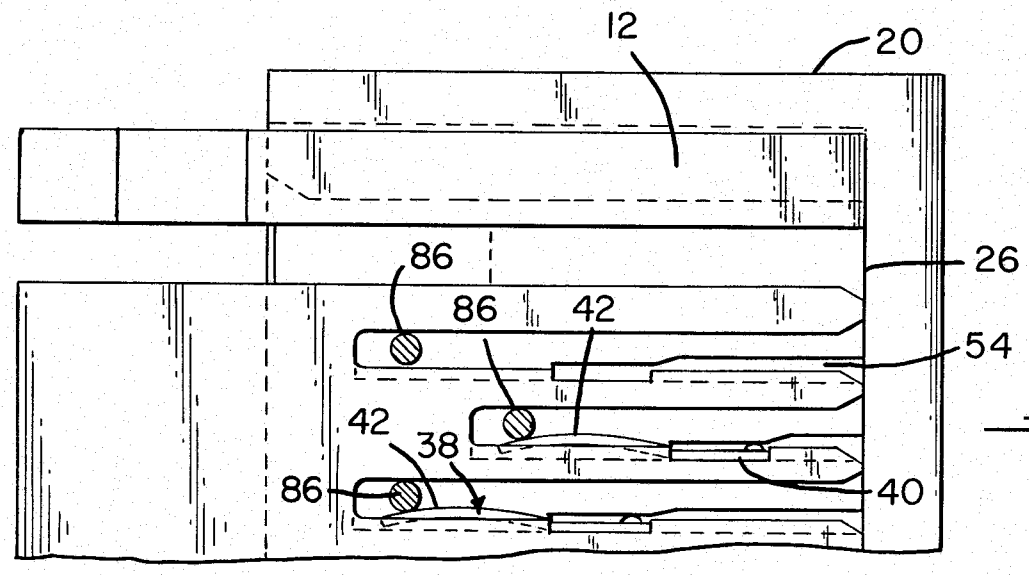
FIG. 3 is a view similar to FIG. 2 showing the subject connector system in the mated condition.
Figure 4:
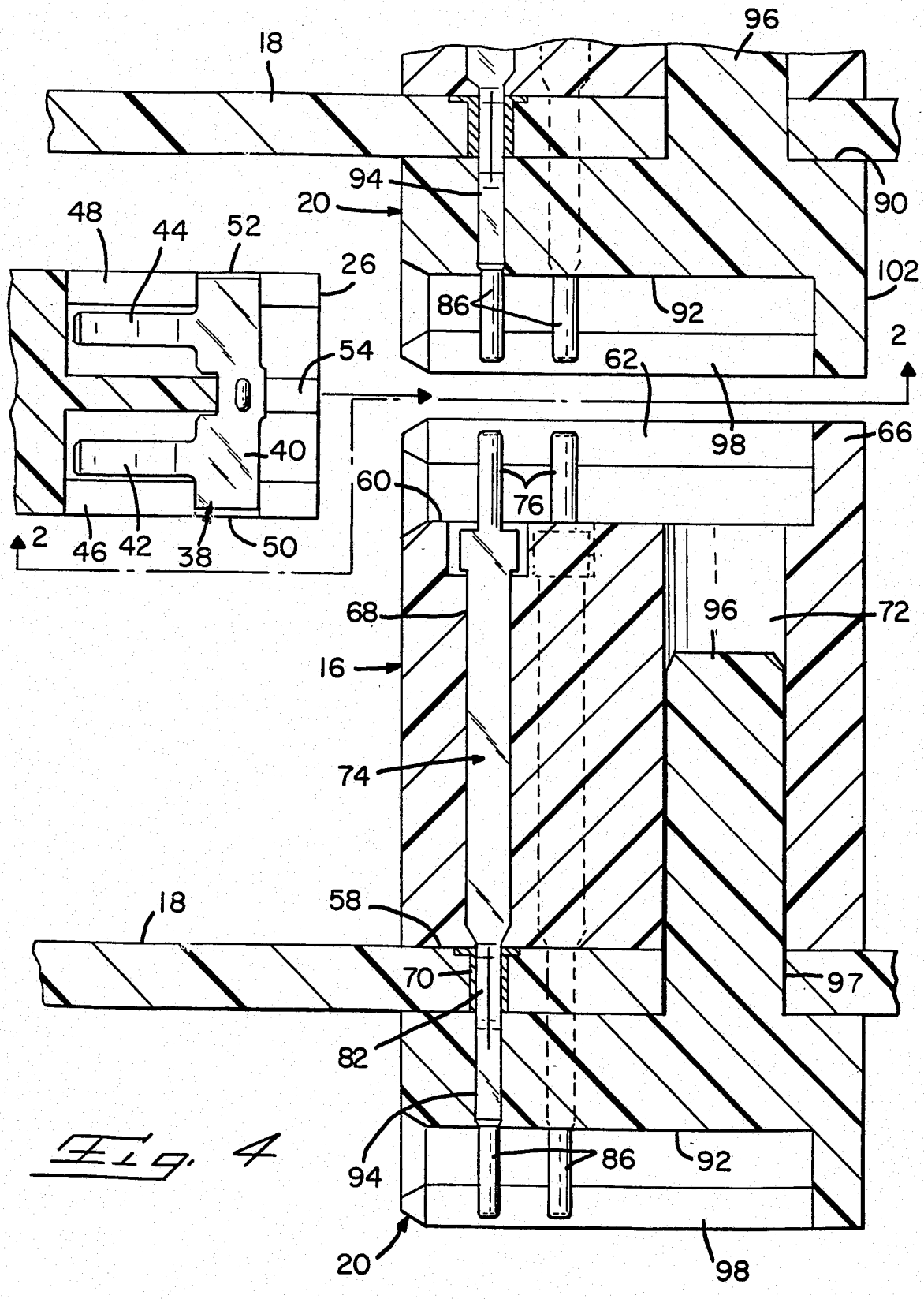
FIG. 4 is a section through the subject connector system in the unmated condition.

The mounting of the header 16 and shroud 20 on opposite sides of the circuit boards 18 with a single pin terminal 74 extending through the header 16, shroud 20, and circuit board 18, provides the circuit board 18 with the capability of being bussed from both sides. A bussing connector 12 can be inserted between the header 16 of a first circuit board and a shroud 20 of a second circuit board, as shown in FIG. 4, to make a bussing interconnect between the circuit boards. It will be noted from FIGS. 2 and 3 that the pin terminals 74 have been shown on a staggered array which conforms with the array of the slots 24. The pin terminals 74 will pass down the respective grooves 46, 48 and in doing so will come to rest against the free ends of the respective legs 42, 44 as shown in FIG. 3.

Figure 7:
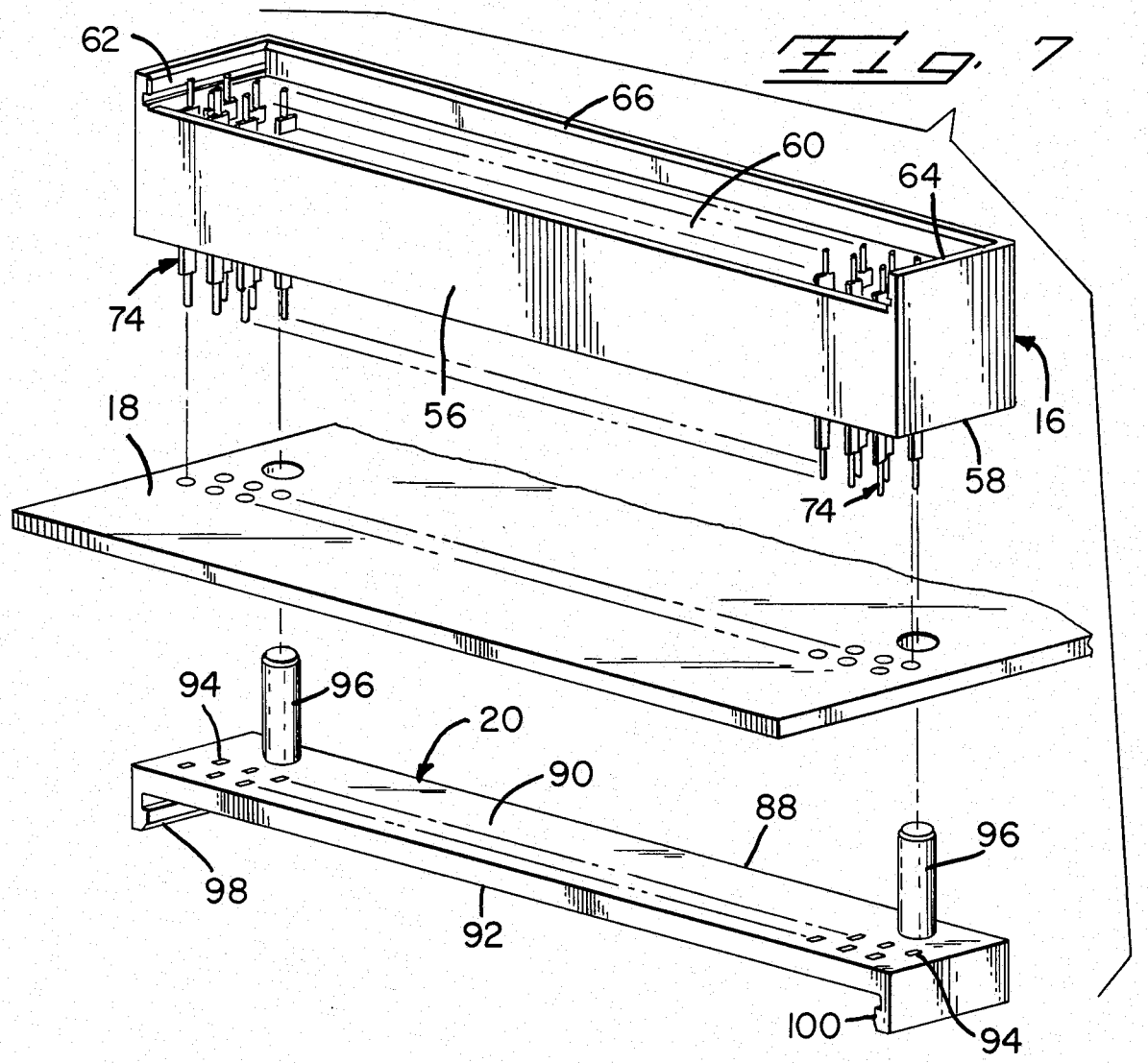
FIG. 7 is a perspective view of the connector members of the subject connector system exploded from an edge portion of a circuit board.

FIG. 7 shows in an exploded view, the manner in which the subject header 16 and shroud 20 are mounted on a circuit board 18. The terminals 74 are preloaded in the header 16 from mating face 60 with shoulders 78 preventing the terminals from dropping through passages 68. The compliant portions 82 are positioned to engage in the conductive apertures 70 of the circuit board. The second bodies 84 are received in the shroud 20 with the second pins 86 extending from mating face 92. The compliant portions of the pins hold the header 16 on the circuit board but it is the engagement of studs 96 in apertures 72 which holds the shroud on the circuit board. Of course, other known mounting means could be used without departing from the invention.

Figure 8:
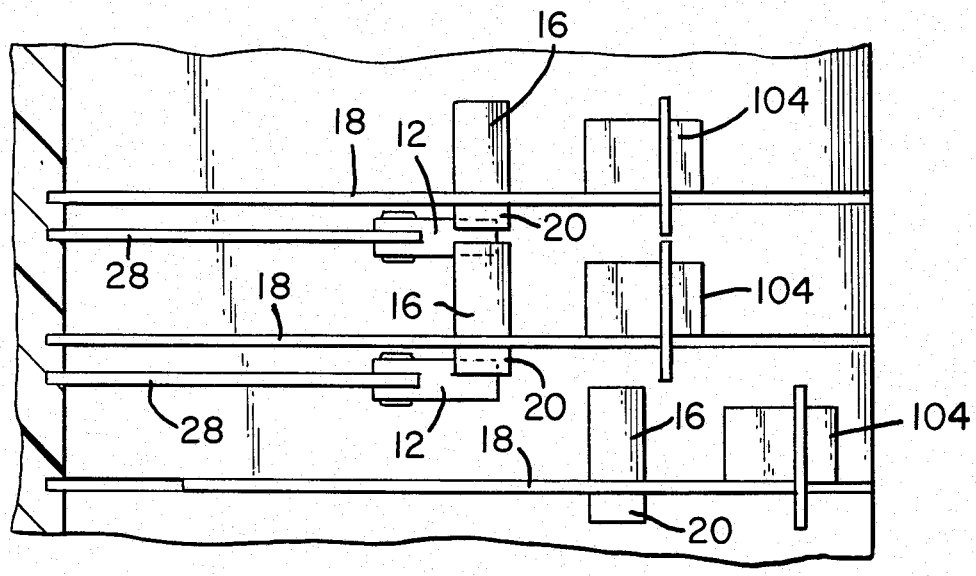
FIG. 8 is a side elevation schematically illustrating the operation of the present invention.

FIG. 8 is a schematic illustration of how the subject invention can be used to bus together a number of circuit boards that are mounted in a parallel spaced fashion. Each circuit board would also be provided with a known connector 104. The keyed end walls of the headers and shrouds assure proper mating with the bussing connector.

FIGS. 9 and 10 show alternate embodiments of the subject bussing connector. The handle embodiment of FIG. 9 would allow it to be used separately from a mother circuit board or chassis, as in the previous embodiments. FIG. 10 shows how the bussing connector could be used to make a bussing interconnect within an array of circuit boards. In this instance the central mother circuit board could bus to two adjacent daughter circuit boards (not shown).

FIG. 11 shows an embodiment of the invention in a backplane mounting arrangement. This would be a substitute for the previous mother board or chassis mounting arrangements.

We claim:

1. A bussing system for interconnecting circuits on pairs of adjacent parallel spaced circuit boards, comprising:

an elongated bussing connector having a housing of rigid insulative material defining a plurality of parallel spaced profiled slots inwardly directed from a mating face, each slot including a groove on each opposite side face of the connector extending away from the mating face in parallel spaced fashion, a plurality of receptacle terminals each mounted in a respective slot and each having a cross bar portion and a pair of parallel spaced contact legs lying in respective grooves; and a connector assembly on each circuit board comprising a pin header and a pin shroud mounted on opposite sides of a mating edge portion of each said circuit board, each said pin header and said pin shroud having a housing of rigid insulative material with a plurality of terminal passages extending therethrough, each passage aligned with a respective conductive aperture in said circuit board, a like plurality of pin terminals each extending through respective ones of said passages and conductive aperture to project from both oppositely directed mating faces of said pin header and pin shroud whereby receptacle terminals of a bussing connector engaging the terminal pins extending from the mating face of a pin header of a first circuit board and a pin shroud of a second circuit board busses together the circuits of said first and second circuit boards.

2. A bussing system according to claim 1 wherein said bussing connector is chassis mounted.

3. A bussing system according to claim 1 wherein said bussing connector includes a handle.

4. A bussing system according to claim 1 wherein said bussing connector is mounted on a mother circuit board.

5. A bussing system according to claim 1 wherein said bussing connector is back plane mounted.

6. A bussing system according to claim 1 wherein each said receptacle terminal further comprises retention means to secure said terminal in a respective slot of said bussing connector housing.

7. A bussing system according to claim 1 wherein said bussing connector housing, said pin header housing and said pin shroud all have keying profiles.

8. A bussing system according to claim 1 wherein each said pin terminal comprises:

an elongated conductive member having an intermediate compliant portion for engaging said conductive aperture, body portions extending from opposite ends of said compliant portion lying in respective passages of said header and said shroud, and pin portions extending beyond mating faces of said header and said shroud to be engaged by said receptacle terminals.

9. A bussing system according to claim 1 further comprising:

means to mount said pin header and said pin shroud on opposite sides of a respective circuit board.

10. A bussing system according to claim 9 wherein said means to mount said pin header comprises said compliant portions of said pin terminals.

11. A bussing system according to claim 9 wherein said means to mount said pin shroud comprises means extending from said pin shroud frictionally interengageable with recess means in said pin header.

12. A bussing system for interconnecting circuits on pairs of adjacent parallel spaced circuit boards, comprising:

an elongated bussing connector housing of rigid insulative material having a mating face and defining a plurality of parallel spaced profiled slots, each slot including a groove on each opposite side face of the connector extending away from the mating face in parallel spaced fashion, a plurality of receptacle terminals each mounted in a respective slot and each having a cross bar portion and a pair of integral parallel spaced contact legs each leg lying in a respective groove; and a connector assembly on an edge portion of each circuit board having a pin header and a pin shroud mounted on opposite sides of an edge portion of each said circuit board, and a plurality of pin terminals passing through the circuit board to extend from mating faces of said pin header and said pin shroud characterized by each said pin header and said pin shroud being formed of rigid insulative material having a plurality of terminal passages extending therethrough between a circuit board engaging surface and an oppositely directed mating face, each passage aligned with a respective conductive aperture in said circuit board, said pin terminals each having a compliant mounting section intermediate two body portions, the former engaging in a respective conductive aperture and the latter extending through said passages in said pin header and said pin shroud, each said pin terminal having end pin portions which project from both oppositely directed mating faces of said pin header and pin shroud whereby a bussing connector engages the pin portions extending from the mating face of a pin header of a first circuit board and a pin shroud of a second circuit board.

13. A bussing system according to claim 12 characterized by said contact legs of said receptacle terminals being resilient and constricting the respective groove of said bussing connector housing so as to interfere with a pin portion of a pin terminal entering said groove to make good electrical and mechanical contact therewith.

14. A bussing system according to claim 12 characterized by keying means on said pin header, said pin shroud and said bussing connector.

15. A bussing system according to claim 12 characterized by mounting projections extending from said pin shroud through apertures in said circuit board to frictionally engage in recesses in said pin header to secure said pin header and said pin shroud to an edge portion of said circuit board.

* * * * *